US005099289A

United States Patent [19]

Kurotori et al.

[11] Patent Number: 5,099,289

[45] Date of Patent: Mar. 24, 1992

[54] ELECTROPHOTOGRAPHIC WET-TYPE IMAGE FIXING UNIT FOR USE WITH COPY PAPER AND TRANSPARENCIES

[75] Inventors: Tsuneo Kurotori, Tokyo; Manabu Mochizuki; Kenzou Ariyama, both of Yokohama, all of Japan

[73] Assignee: Ricoh Company, Ltd., Tokyo, Japan

[21] Appl. No.: 652,226

[22] Filed: Feb. 6, 1991

Related U.S. Application Data

[63] Continuation of Ser. No. 330,699, Mar. 30, 1989, abandoned.

[30] Foreign Application Priority Data

Apr. 2, 1988 [JP] Japan ..... 63-82624
Jun. 20, 1988 [JP] Japan ..... 63-151575
Dec. 1, 1988 [JP] Japan ..... 63-305050

[51] Int. Cl.[5] ..... G03G 15/20

[52] U.S. Cl. ..... 355/290; 355/256; 355/284

[58] Field of Search ..... 355/256, 282, 285, 289, 355/290, 311, 315, 284; 271/312; 219/216; 432/60

[56] References Cited

U.S. PATENT DOCUMENTS 4,791,447 12/1988 Jacobs ..... 355/290

FOREIGN PATENT DOCUMENTS 60-104984 6/1985 Japan ..... 355/290
62-89979 4/1987 Japan ..... 355/284

*Primary Examiner*—Joan H. Pendegrass
*Attorney, Agent, or Firm*—Oblon, Spivak, McClelland, Maier & Neustadt

[57] ABSTRACT

An image fixing unit for use in a wet-type electrophotographic copying machine capable of forming a latent electrostatic image on a photoconductor element, developing said latent electrostatic image to a visible toner image and transferring said visible toner image to a transfer sheet, including (a) a first image-fixing section for heating directly an unfixed toner image formed on a transfer sheet by a developer which includes a toner and a carrier liquid, thereby fixing the toner image to the transfer sheet, the transfer sheet having a carrier liquid absorbing capacity A or B with respect to the carrier liquid, where A>B; (b) a second image-fixing heating section for minimizing the content of the carrier liquid in the developer by which the toner image is formed, thereby fixing the toner image to the transfer sheet by application of heat thereto; and (c) a switching device for selectively making operable at least one of the first image-fixing heating section or the second image-fixing heating section, depending upon the carrier liquid absorbing capacity of the transfer sheet.

9 Claims, 10 Drawing Sheets

ELECTROPHOTOGRAPHIC WET-TYPE IMAGE FIXING UNIT FOR USE WITH COPY PAPER AND TRANSPARENCIES

This application is a continuation of application Ser. No. 07/330,699, filed on Mar. 30, 1989, now abandoned.

BACKGROUND OF THE INVENTION

1. Field of the Invention

The present invention relates to an image fixing unit for use in a wet-type electrophotographic copying machine.

2. Discussion of Background

In a wet-type electrophotographic copying machine, there is conventionally known an image fixing method comprising the steps of developing a latent electrostatic image formed on a photoconductive member to a visible toner image with a liquid-type developer, transferring the visible toner image to a transfer sheet, and fixing the transferred image to the transfer sheet by bringing heat application means into direct contact with the toner-image-bearing surface of the transfer sheet.

As shown in FIG. 1, for example, a heat-application roller 1 with an inner heater 3 serving as a heat-application means incorporated therein is disposed along a paper transportation path through which an unfixed toner-image-bearing transfer sheet P advances in the direction of the arrow, and a pressure-application roller 2 is in pressure contact with the heat-application roller 1. More specifically, a cam surface of a pressure-application cam 5 is in pressure contact with a shaft portion of the pressure-application roller 2 by the urging force of a spring 6, so that a predetermined pressure is applied to the pressure-application roller 2, thus the pressure-application roller 2 is brought into pressure contact with the heat-application roller 1. Around the heat-application roller 1, there are provided a thermistor 7 and a temperature-control fuse 8 to control the temperature of the heat-application roller 1. A transfer sheet separating pawl 10 and a silicone-oil-application felt 11 are situated in contact with the surface of the heat-application roller 1, so that the transfer sheet is prevented from being wound around the heat-application roller 1.

However, the above-mentioned conventional image fixing unit for use in an electrophotographic copying machine has the shortcoming in that the image quality of fixed image varies depending on the kind or type of a transfer sheet P employed. In particular, when transfer sheets which scarcely absorb a carrier liquid contained in a liquid developer, that is, transfer sheets having a low carrier liquid absorbing capacity, such as a transparent film for overhead projectors (OHP), an intermediate original sheet and art paper, are employed, an unfixed toner image on the transfer sheet is caused to corrupt or flow in the course of image fixing because of the presence of the excess carrier liquid remaining in the developed toner image and accordingly the fixed image becomes illegible.

In order to solve the above problem, an image fixing test was carried out to analyze the relationship between a carrier liquid retention ratio in a developer deposited imagewise on a variety of transfer sheets and the occurrence of image flow in the obtained toner images.

The above-mentioned carrier liquid retention ratio of the developer was obtained according to the following formula:

$$\text{Carrier liquid retention ratio (\%)} = \frac{[\text{Total weight of transfer sheet before dried (g)}] - [\text{Total weight of transfer sheet after dried (g)}]}{\text{Total weight of transfer sheet before dried (g)}} \times 100$$

To obtain the above-mentioned carrier liquid retention ratio of the employed developer, a liquid-type developer was prepared by dispersing and diluting a thermal cross-linking toner in a carrier liquid such as "Isopar H" made by Exxon Co., with a dilution ratio of 50 g/l. Latent electrostatic images were developed to toner images on a commercially available transparent film for OHP (Trademark "TYPE PPC-DX" (A4 size) made by Ricoh Company Ltd.) by use of the above-mentioned developer and a commercially available electrophotographic copying machine. The thus developed OHP film was taken out from the electrophotographic copying machine before reaching an image fixing unit of the copying machine. The weight of the OHP film was measured. After this measurement, the OHP film was then dried through the image fixing unit to evaporate the carrier liquid, and the weight thereof was measured, so that the carrier liquid retention ration (%) was obtained in accordance with the above-mentioned formula. In the above-mentioned image fixing test, the fixing temperature was adjusted to 140° ±10° C. and the paper feeding linear speed was set at 350 mm/sec.

The results are set forth in Table 1.

TABLE 1

| Carrier Liquid Retention Ratio (%) | Image Flow | | | |
|---|---|---|---|---|
| | OHP Film (*) | Intermediate Original Sheet (**) | Art Paper (***) | Plain Paper (T-6200) |
| 77 | 1 | 1 | 2 | 5 |
| 72 | 2 | 2 | 3 | 5 |
| 68 | 2 | 3 | 3 | 5 |
| 65 | 2.5 | 3 | 3.5 | 5 |
| 60 | 3 | 3 | 4 | 5 |
| 55 | 4 | 4 | 5 | 5 |
| 45 | 4.5 | 5 | 5 | 5 |
| 9 | 5 | 5 | 5 | 5 |

(*) A commercially available transparent film for the OHP "TYPE PPC-DX" made by Ricoh Company Ltd.
(**) A commercially available intermediate original sheet "TYPE TA" made by Ricoh Company Ltd.
(***) A commercially available duplex coated paper.

In Table 1, the image flow was evaluated by visual inspection and the degree of the image flow is expressed by the following ranking scale:

1: Image flow is observed in all the obtained images so that the characters are illegible.
2: Image flow is slightly observed in the obtained images and the image density of the solid image areas is low.
3: Image flow occurs less, but the characters in the solid image areas spread.
4: Image flow is hardly observed, but the characters in the solid image areas slightly spread.
5: Image flow is not observed at all and the characters in the solid image areas are clear.

The results in Table 1 indicate that when the carrier liquid retention ratio in the developer deposited on the transfer sheet is 65% or more, image flow takes place to some extent in the fixed images on the OHP film, the intermediate original sheet and the art paper.

However, a satisfactory image fixing unit capable of attaining effective image fixing for use in a wet-type electrophotographic copying machine, by controlling the above discussed carrier liquid retention ratio, has not been proposed.

In addition, the conventional image fixing units have the shortcoming that the durability of the heat-application roller 1 is low. More specifically, the surface of the heat-application roller 1 is easily scratched or damaged by the transfer sheet separating pawl 10, in particular when the heat-application roller 1 is coated with silicone rubber, because the transfer sheet separating pawl 10 is always in contact with the surface of the heat-application roller 1.

Another shortcoming of the conventional image fixing units is that the effect of the silicone-oil-application felt 11 is readily deteriorated with time. As shown in FIG. 1, the silicone-oil-application felt 11 is situated in contact with the surface of the heat-application roller 1 and serves to uniformly apply silicone oil to the surface of the heat-application roller 1 in order to facilitate the separation of the transfer sheet from the heat-application roller after image fixing. However, some foreign materials such as offset toner particles and paper dust are gradually deposited and accumulate on a tip 11*a* of the silicone-oil-application felt 11 as shown by a shaded portion 11*b* each time the transfer sheet is caused to pass through the image fixing unit. Eventually the silicone-oil-application felt 11 does not work effectively. Therefore periodical replacement of the silicone-oil-application felt 11 is unavoidable.

Furthermore, in the case where a silicone oil is supplied to the heat-application roller 1 by a silicone-oil-application roller (not shown) and the above-mentioned foreign materials are removed from the heat-application roller 1 by a scraper blade (not shown) which is disposed in contact with the surface of the heat-application roller 1, if the heat-application roller 1 is rotated in the same direction as the rotating direction of the silicone-oil-application roller, that is, when the movements of the surfaces of the two rollers are opposite at their contact point, the foreign materials accumulated on the tip of the scraper blade are transferred back to the heat-application roller 1, so that not only the surface of the heat-application roller 1, but also the transfer sheets are smeared by the retransferred foreign materials.

SUMMARY OF THE INVENTION

It is therefore a first object of the present invention to provide an improved image fixing unit for use in a wet-type electrophotographic copying machine free from the conventional shortcomings, capable of minimizing the carrier liquid retention ratio of the developer deposited imagewise on transfer sheets, in particular on transfer sheets having low carrier-liquid-absorbing capacity, in the course of image fixing, thereby minimizing the occurrence of image flow and thus providing clear and sharp images.

A second object of the present invention is to provide an improved image fixing unit for use in a wet-type electrophotographic copying machine, capable of easily and effectively separating transfer sheets from a heat-application roller after image fixing, without scratching or damaging the surface of the heat-application roller.

A third object of the present invention is to provide an improved image fixing unit for use in a wet-type electrophotographic copying machine, capable of minimizing the transportation of foreign materials such as offset toner particles and paper dust to the heat-application roller, thereby preventing the transfer sheets from being smeared by such foreign materials.

The first object of the present invention can be achieved by an image fixing unit comprising a first image-fixing heating means and a second image-fixing heating means, in which the first image-fixing heating means directly heats the surface of an unfixed-toner-image bearing transfer sheet, and the second image-fixing heating means heats the back side of the unfixed-toner-image bearing transfer sheet. Thus, image fixing is carried out by use of at least one image-fixing heating means of the first or second heating means, which can be selectively employed depending on the type of the transfer sheet, in particular, depending upon the carrier liquid absorbing capacity thereof. In this image fixing unit, it is preferable that one of image-fixing heating means which is not used be positioned away from the transfer sheet.

In particular, when image fixing is performed on special transfer sheets having low carrier liquid absorbing capacity, the first image-fixing heating means is selectively made inoperable or deenergized or detached from the paper transportation path so as to be positioned out of contact with the unfixed-toner-image bearing transfer sheet, and only the second image-fixing heating means is made operable or energized. This is because the second image-fixing heating means is not in contact with the unfixed-toner-image bearing transfer sheet, so that the image flow is not caused in the obtained images by the second image-fixing heating means, and the first image-fixing heating means is also out of contact with the transfer sheet. Thus, the occurrence of the hot-offset of the images to the transfer sheet via the first image-fixing heating means can also be avoided.

The second object of the present invention can be achieved by an image fixing unit having a transfer sheet separation member incorporated therein, which member is situated facing a heat-application roller in order to prevent the transfer sheet from winding around the heat-application roller after the completion of image fixing. Preferably the transfer sheet separation member is a paper separation roller which is designed to rotate in the same direction as the direction of rotation of the heat-application roller, with a small clearance interposed therebetween.

The third object of the present invention can be achieved by an image fixing unit in which a pressure-application roller is situated below a heat-application roller in rolling contact therewith to constitute a first image fixing section, and a plurality of transfer-sheet-holding rollers are situated above the heat-application roller in close vicinity thereof to constitute a second image fixing section, and for instance, when the heat-application roller is driven in rotation in a clockwise direction, image fixing can be performed in the first image fixing section, while when it is driven in rotation in a counterclockwise direction, image fixing can be performed in the second image fixing section, and there are provided a first silicone-oil-application roller in rolling contact with the heat-application roller, a second silicone-oil-application roller in rolling contact with the first silicone-oil-application roller, a scraper blade in contact with the second silicone-oil-application roller, and a member for stopping the rotation of the second silicone-oil-application roller when the second image fixing section is selected and the heat-application roller is driven in rotation in the counterclockwise direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
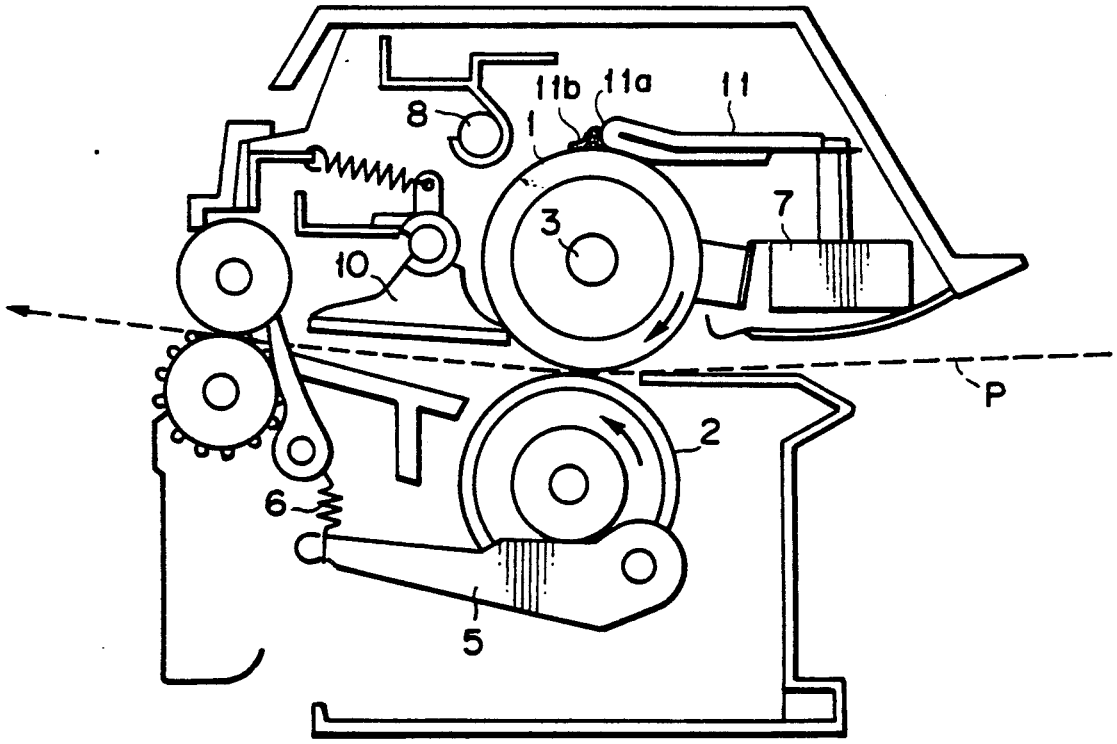
FIG. 1 PRIOR ART
FIG. 1 is a schematic cross-sectional view of a conventional image fixing unit for use in a wet-type electrophotographic copying machine.

An image fixing unit for use in a wet-type electrophotographic copying machine according to the present invention will now be explained in detail by referring to the accompanying drawings.

Referring now to the drawings, wherein like reference numerals designate identical or corresponding parts throughout the accompanying drawings.

The image fixing unit according to the present invention comprises (a) a first image-fixing heating means for heating directly an unfixed toner image formed on a transfer sheet by a developer comprising a toner and a carrier liquid, thereby fixing the toner image to the transfer sheet, which transfer sheet may have a carrier liquid absorbing capacity A or B with respect to the carrier liquid, where $A>B$; (b) a second image-fixing heating means for minimizing the content of the carrier liquid in the developer by which the toner image is formed, thereby fixing the toner image to the transfer sheet by application of heat thereto; and (c) switching means for selectively making operable at least one of the first image-fixing heating means or the second image-fixing heating means, depending upon the carrier liquid absorbing capacity of the transfer sheet, in such a manner that when the transfer sheet has a carrier liquid absorbing capacity A, at least the first image-fixing heating means is made operable, while when the transfer sheet has a carrier liquid absorbing capacity B, at least the second image-fixing heating means is made operable.

Figure 2A:
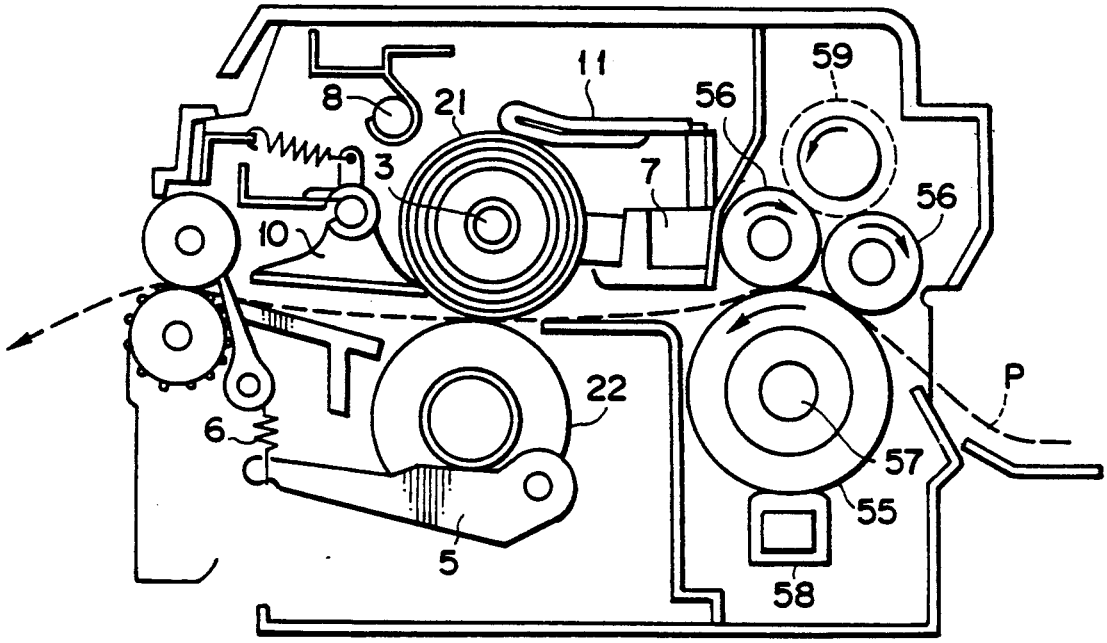
FIG. 2A is a schematic cross-sectional view of a first example of an image fixing unit according to the present invention, which is in an image fixing mode for fixing images on a transfer sheet having a relatively large carrier liquid absorbing capacity.
Figure 2B:
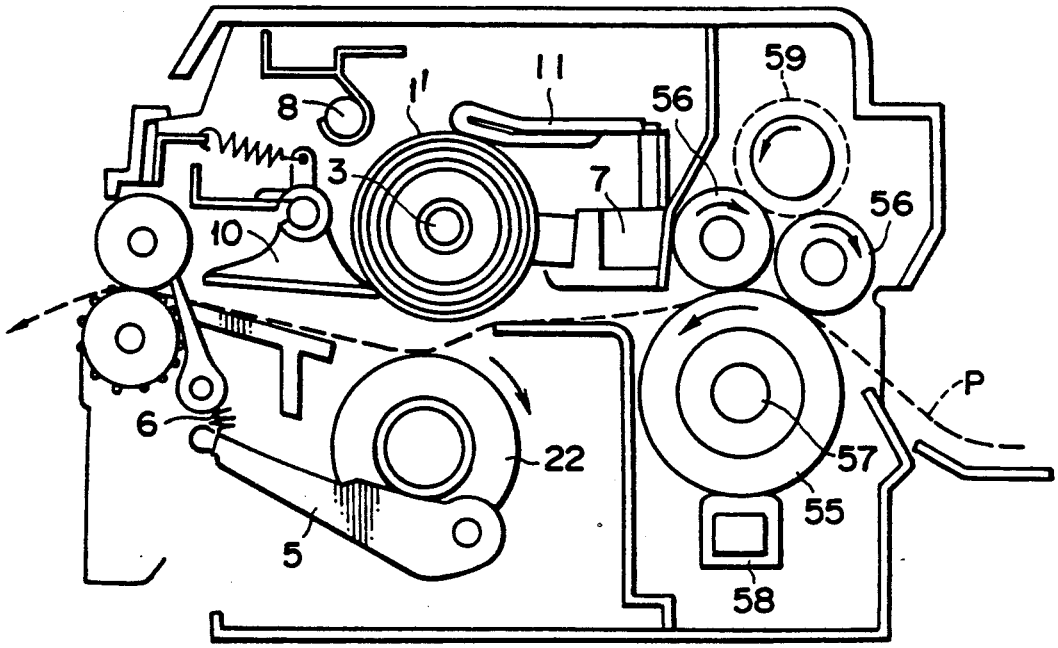
FIG. 2B is a schematic cross-sectional view of the first example of an image fixing unit according to the present invention, which is in an image fixing mode for fixing images on a transfer sheet having a relatively small carrier liquid absorbing capacity.

FIGS. 2A and 2B schematically show a first example of the image fixing unit of the present invention. In this example, a carrier liquid retention ratio of a developer deposited imagewise on a transfer sheet P can be decreased or minimized by energizing the first image-fixing heating means or the second image-fixing heating means which is provided independently of the above-mentioned first image-fixing heating means.

More specifically, before a first image fixing section whose structure is almost the same as that of the image fixing unit as shown in FIG. 1, there is provided a second image fixing section along a paper transportation path. In the second image fixing section, a heat-application roller 55 with an inner heater 57 serving as a heat-application means is disposed along the paper transportation path through which an unfixed-toner-image bearing transfer sheet P advances in the direction of the arrow, and a plurality of transfer-sheet-holding rollers 56 are disposed in close vicinity of the heat-application roller 55. The above-mentioned transfer-sheet-holding rollers 56 are emery rollers, for example, having fine protrusions with a height of 50 to 500 μm on the surface thereof and are situated adjacent to the heat-application roller 55, with a gap of 0.2 to 0.5 mm interposed therebetween. A cleaning pad 58 is situated in contact with the heat-application roller 55 in order to remove foreign materials such as toner particles and paper dust from the surface of the heat-application roller 55. Reference numeral 59 indicates a cleaning roller which serves to remove foreign materials such as toner particles and paper dust from the surface of the transfer-sheet-holding rollers 56.

In the first example, as shown in FIGS. 2A and 2B, either of the two above-mentioned image fixing sections is selected as follows, depending on the type of the transfer sheet P, for example, transfer sheets with high carrier liquid absorbing capacity such as plain paper, or transfer sheets with low carrier liquid absorbing capacity such as a transparent film for overhead projectors (OHP), an intermediate original sheet and art paper.

(1) In the case of transfer sheets with high carrier liquid absorbing capacity (FIG. 2A)

An inner heater 3 incorporated in a first heat application roller 21 in the first image fixing section is turned on and the inner heater 57 incorporated in the second heat application roller 55 is turned off, for example, by depressing a selection key on an operating panel (not shown) mounted on an electrophotographic copying machine. A transfer sheet P is caused to pass the nip between the first heat application roller 21 and a first pressure-application roller 22, so that an unfixed toner image formed on the transfer sheet P is fixed to the transfer sheet P. In this case, the second heat-application roller 55 and the second transfer-sheet-holding rollers 56 merely serve as paper transportation rollers.

An image fixing test was carried out to evaluate the image quality obtained by a commercially available plain paper (Trademark "Type 6200" made by Ricoh Company, Ltd.) and a rag paper containing 25% of cotton when used as transfer sheets by raising the image fixing temperature with intervals of 10° C. from 100° C. to 180° C.

In the above-mentioned image fixing test, the ambient temperature and humidity were respectively adjusted to 25° C. and 62%RH, and the paper feeding linear speed was set at 350 mm/sec. The results are set forth in Table 2.

TABLE 2

| Image Fixing Temp. (°C.) (Inner Heater 3) | Image Density | | Image Fixing Performance | | Hot-offset | |
|---|---|---|---|---|---|---|
| | Plain Paper | Rag Paper | Plain Paper | Rag Paper | Plain Paper | Rag Paper |
| Heater 3 is turned off. | 1.22 | 1.02 | 1 | 1 | — | — |
| 100 | 1.30 | 1.14 | 2 | 1 | 5 | 5 |
| 110 | 1.33 | 1.23 | 3 | 2 | 5 | 5 |
| 120 | 1.39 | 1.27 | 4 | 3 | 5 | 5 |
| 130 | 1.43 | 1.33 | 5 | 4 | 5 | 5 |
| 140 | 1.48 | 1.35 | 5 | 4 | 5 | 5 |
| 150 | 1.50 | 1.37 | 5 | 4 | 4 | 5 |
| 160 | 1.50 | 1.40 | 5 | 5 | 2 | 3 |
| 180 | 1.53 | 1.42 | 5 | 5 | 2 | 2 |

In Table 2, the image fixing performance was evaluated by rubbing the obtained images with an individual's finger to see if there was smearing thereof and is expressed by the following ranking scale:

1: Obtained images are rubbed off very easily.
2: Obtained images are readily smeared by slight rubbing.
3: Obtained images are slightly smeared by normal rubbing.
4: Obtained images are not smeared at all by normal rubbing.
5: Obtained images are not smeared at all even by strong rubbing.

The hot-offset, also given in Table 2, was evaluated by visual inspection, and the degree of the hot-offset is expressed by the following ranking scale:

1: Hot-offset is observed not only in solid image areas, but also in line image areas with line images having a width of 1 mm or less.
2: Hot-offset is observed at the rear end portions of solid image areas.
3: Hot-offset is slightly observed in the rear end portions of solid image areas.
4: Hot-offset can be seen only when inspected by a loupe.
5: Hot-offset can not be observed at all.

The results shown in Table 2 indicate that when the image fixing temperature is set at 140° ±10° C., the obtained image quality is excellent.

(2) In the case of transfer sheets with low carrier liquid absorbing capacity (FIG. 2B)

The inner heater 3 incorporated in the first heat application roller 21 is turned off and the inner heater 57 incorporated in the second heat application roller 55 is turned on. A transfer sheet P is caused to pass between the second heat-application roller 55 and the second transfer-sheet-holding rollers 56, so that an unfixed toner image formed on the transfer sheet P is fixed thereto. In this case, the first pressure-application roller 22 is preferably released from the first heat-application roller 21 for avoiding the hot-offset phenomenon, for instance, with a gap of 0.3 to 5 mm between the first pressure-application roller 22 and the first heat-application roller 21 as shown in FIG. 2B.

An image fixing test was carried out to evaluate the image quality obtained by an OHP film, an intermediate original sheet and art paper when used as transfer sheets, by raising the image fixing temperature with intervals of 20° C. from 100° C. to 220° C.

In the above-mentioned image fixing test, the ambient temperature and humidity were respectively adjusted to 25° C. and 60%RH, and the paper feeding linear speed was set at 350 mm/sec. In this image fixing test, the same OHP film, intermediate original sheet and art paper as those employed in the test as shown in Table 1 were respectively used. The results are given in Table 3.

TABLE 3

| Image Fixing Temp. (°C.) (Inner Heater 3) | Image Density | | | Image Fixing Performance Determined by Smear | | |
|---|---|---|---|---|---|---|
| | OHP Film | Intermediate Original Sheet | Art Paper | OHP Film | Intermediate Original Sheet | Art Paper |
| Heater 57 is turned off. (20~30° C.) | 1.40 | 1.37 | 1.42 | 1 | 1 | 1 |
| 100 | 1.48 | 1.46 | 1.49 | 1 | 1 | 1 |

TABLE 3-continued

| Image Fixing Temp. (°C.) (Inner Heater 3) | Image Density | | | Image Fixing Performance Determined by Smear | | |
|---|---|---|---|---|---|---|
| | OHP Film | Intermediate Original Sheet | Art Paper | OHP Film | Intermediate Original Sheet | Art Paper |
| 120 | 1.50 | 1.50 | 1.53 | 2 | 1 | 2 |
| 140 | 1.51 | 1.50 | 1.53 | 3 | 3 | 3 |
| 160 | 1.53 | 1.55 | 1.55 | 4 | 4 | 4 |
| 180 | 1.55 | 1.55 | 1.55 | 5 | 4 | 5 |
| 200 | 1.55 | 1.54 | 1.55 | 5 | 5 | 5 |
| 220 | 1.56 | 1.55 | 1.55 | 5 | 5 | 5 |

In the above, the image fixing performance was evaluated by rubbing the obtained images with an individual's finger to see if there are smearing thereof. The degree of the image fixing performance is expressed by the same ranking scale as in Table 2.

The results shown in Table 3 indicate that when the image fixing temperature is set at 160° C. or more, the obtained image quality is excellent. When the consumption of electric power is taken into consideration, it is considered that a preferable image fixing temperature is 160° C. for use in practice.

As previously mentioned, in the first example of the image fixing unit according to the present invention as shown in FIGS. 2A and 2B, either the first image fixing section or the second image fixing section is selected depending on the type of the transfer sheet P employed. In one image fixing section which is not selected for image fixing, the inner heater incorporated in the heat-application roller is turned off. Accordingly the electric power required is approximately reduced by half, resulting in energy-serving.

Figure 3:
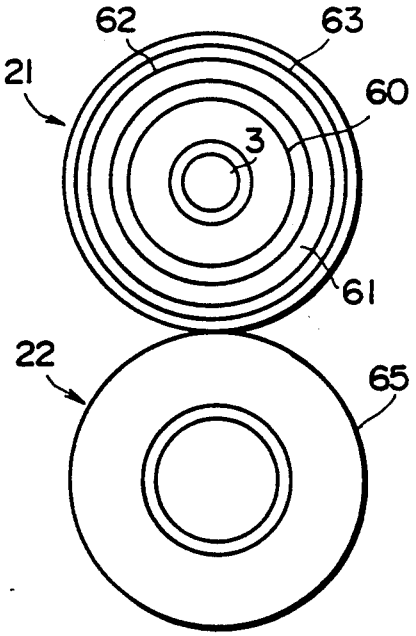
FIG. 3 is an enlarged schematic cross-sectional view of a heat-application roller and a pressure-application for the image fixing unit shown in FIGS. 2A and 2B.

FIG. 3 shows the structure of the above-mentioned first heat-application roller 21, which is constructed in such a manner as shown in the figure that a rubber layer 61, an oil-resisting fluorinated silicone rubber layer 62 and a room temperature vulcanized silicone rubber layer 63 are successively laminated around a core 60 with an inner heater 3 built-in. Alternatively, the first heat-application roller 21 may be formed by coating the core 60 only by the room temperature vulcanized silicone rubber layer 63.

The first pressure-application roller 22 is coated with a Teflon-coated silicone rubber layer 65.

Figure 4:
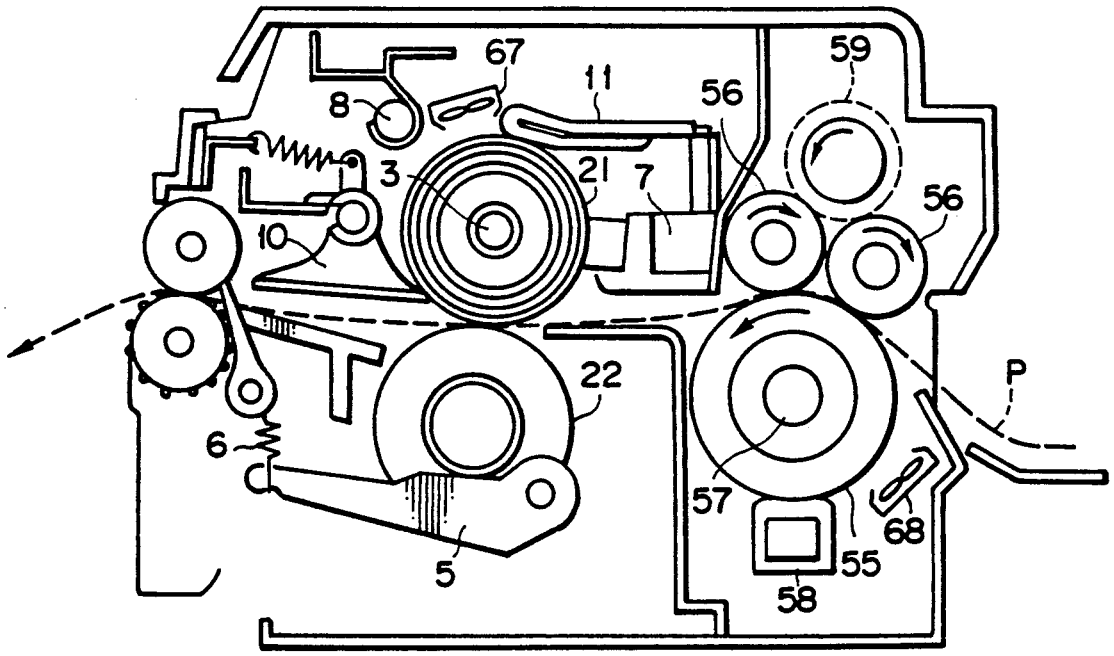
FIG. 4 is a schematic cross-sectional view of a second example of an image fixing unit according to the present invention.

FIG. 4 schematically shows a second example of an image fixing unit according to the present invention. In this example, a first cooling fan 67 and a second cooling fan 68 are additionally incorporated in the image fixing unit shown in FIGS. 2A and 2B.

When fixing images to a transfer sheet with low carrier liquid absorbing capacity after a transfer sheet with high carrier liquid absorbing capacity, the image fixing temperature is required to raise, for instance, from 140° ±10° C. to 160° C. By depressing a selection key on the operation panel (not shown), the inner heater 3 of the first heat-application roller 21 in the first image fixing section is turned off. To lower the temperature of the first heat-application roller 21 rapidly for preventing hot-offset, the cooling fan 67 is energized to blow cool air against the surface of the first heat-application roller 21, without waiting for the natural cool-down thereof.

When the image fixing to the transfer sheet with low carrier liquid absorbing capacity is finished and a transfer sheet with high carrier liquid absorbing capacity is employed again, the image fixing temperature is required to decrease from 160° C. to 140° ±10° C. By depressing the selection key on the operation panel, the inner heater 57 of the second heat-application roller 55 in the second image fixing section is turned off. In this case, to lower the temperature of the second heat-application roller 55 rapidly, second cooling fan 68 is energized to blow cool air against the surface of the second heat-application roller 55. If the surface of the second heat-application roller 55 remains hot for a while after the inner heater 57 is turned off and a developer deposited on a transfer sheet having high carrier liquid absorbing capacity such as rag paper is heated by the second heat-application roller 55 when the transfer sheet is being transported to the first image fixing section, a thermal stretching effect of the toner in the developer is decreased before the transfer sheet reaches the first image fixing section, so that the obtained image density and image uniformity of solid image areas may be decreased when the toner images are fixed to the transfer sheet. However, this does not mean that copy making is impossible until the temperature of the second heat-application roller 55 is lowered to room temperature, because the line images formed on the, above-mentioned rag paper are substantially nonsusceptible to the influence of the residual heat of the second heat-application roller 55 although the solid image areas are susceptible to the heat. Therefore, in the second example of the image fixing unit according to the present invention, switching operation from the first image fixing section to second image fixing section or vice versa, depending on the type of the transfer sheet, is designed to be completed within 60 seconds at most, and the image fixing unit stands ready for subsequent copy making, with the temperature raising time of the inner heater 3 or 57 and the operation of the cooling fan 67 or 68 being taken into consideration.

The image fixing unit for a wet-type electrophotographic copying machine according to the present invention may be modified so as to comprise (a) a first image-fixing heating means comprising a first heating roller and a second heating roller, which can be brought into contact with each other or detached from each other by a switching means; and (b) a second image-fixing means comprising the second heating roller and a transfer-sheet-holding means for holding a transfer sheet on the second heat-application roller, with the back side of the transfer sheet opposite to the unfixed image formed thereon being in contact with the second heat-application roller, and the unfixed toner image formed on the transfer sheet being in close vicinity of the transfer-sheet-holding means.

Figure 5:
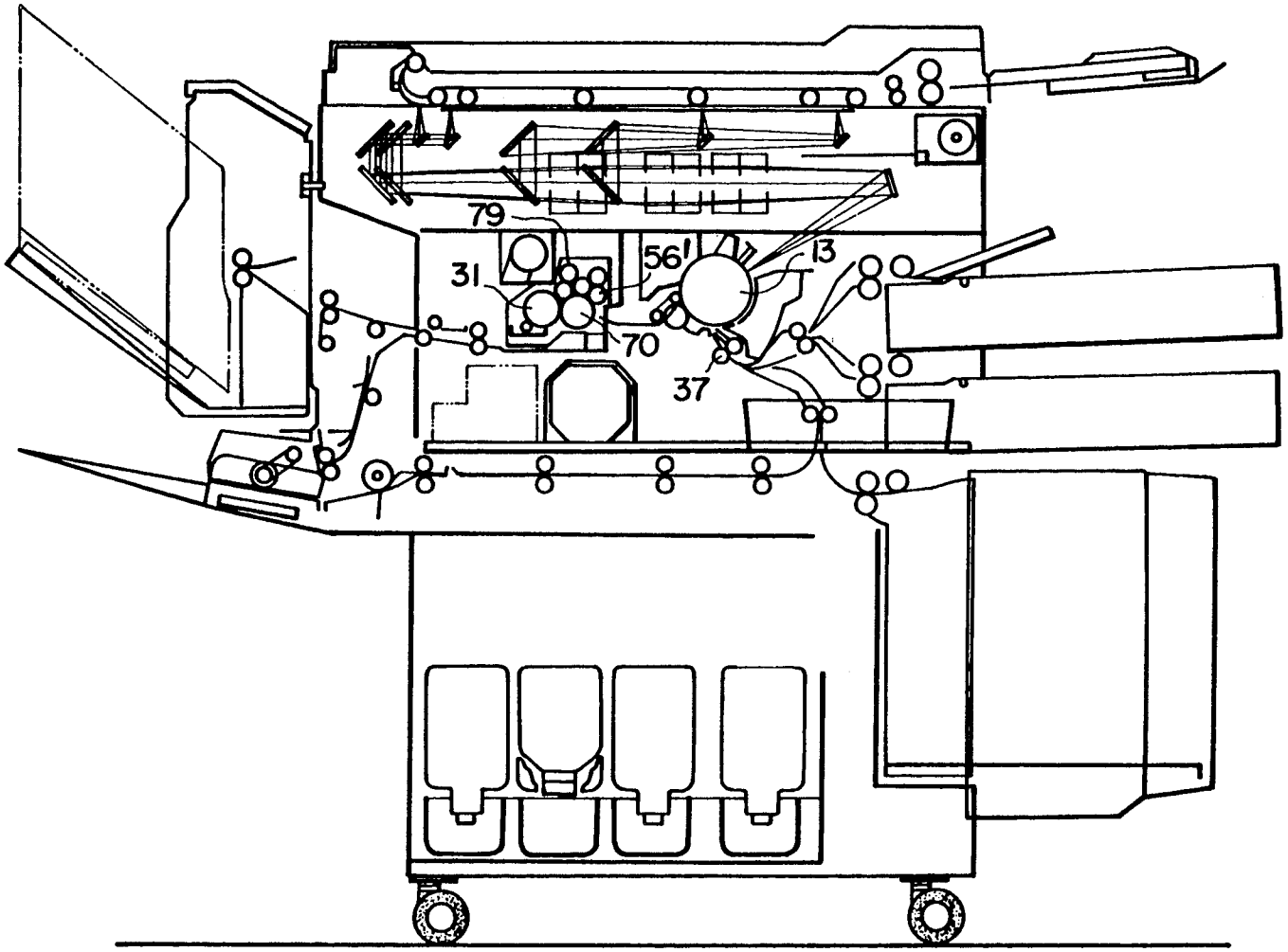
FIG. 5 is a schematic cross-sectional view of an electrophotographic copying machine in which a third example of an image fixing unit according to the present invention is incorporated.
Figure 6A:
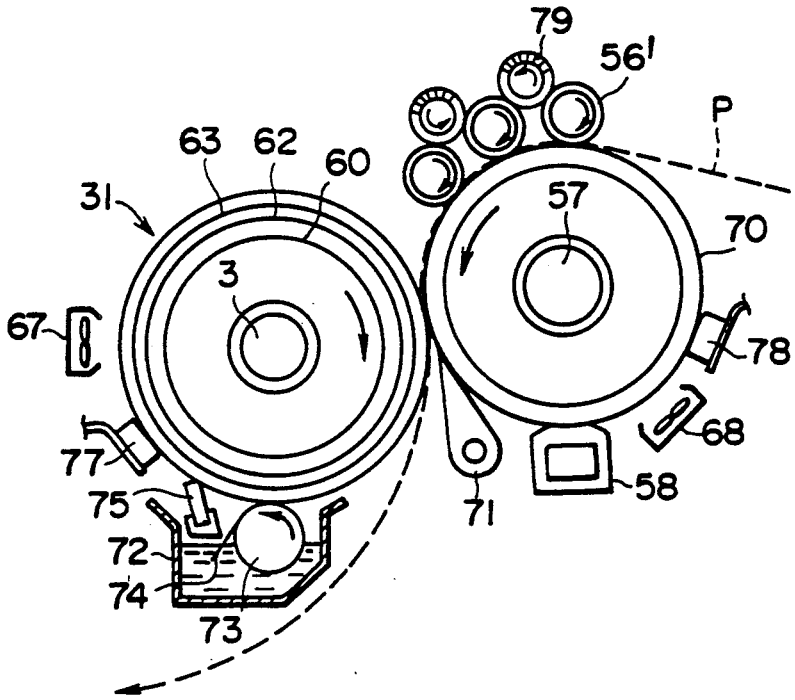
FIG. 6A is a schematic cross-sectional view of the third example of the image fixing unit according to the present invention, which is in an image fixing mode for fixing images on a transfer sheet having a relatively large carrier liquid absorbing capacity.
Figure 6B:
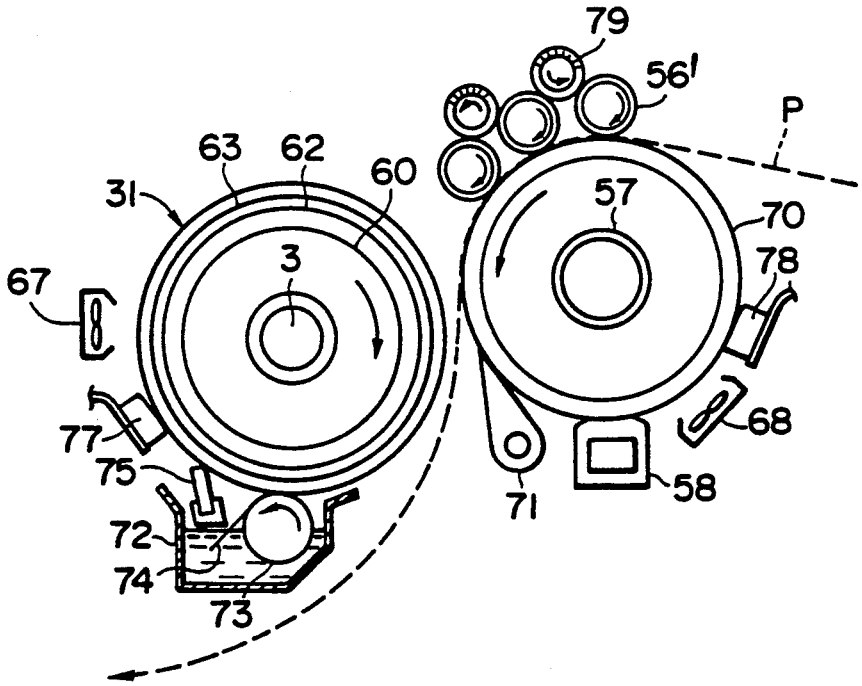
FIG. 6B is a schematic cross-sectional view of the third example of the image fixing unit according to the present invention, which is in an image fixing mode for fixing images on a transfer sheet having a relatively small carrier liquid absorbing capacity.

FIGS. 5, 6A and 6B schematically show an example of the above image fixing unit, which is hereinafter referred to as the third example of the image fixing unit of the present invention. FIG. 5 shows an overall view of an electrophotographic copying machine in which the third example of the image fixing unit shown in FIGS. 6A and 6B is incorporated.

Specifically in the third example of the image fixing unit, the first image-fixing heating means comprises a heat-application roller 31 serving as a first heating roller, and a roller 70 serving as the second heating roller, which rollers 31 and 70 can be brought into contact with each other or detached from each other by a switching means; and the second image-fixing means comprises the roller 70 serving as the second heating roller, and a plurality of transfer-sheet-holding rollers 56' serving as a transfer-sheet-holding means for holding the transfer sheet on the second roller 70, with the back side of the transfer sheet opposite to the unfixed image formed thereon being in contact with the second heat-application roller, and the unfixed toner image formed on the transfer sheet being in close vicinity of the transfer-sheet-holding rollers 56'.

The transfer-sheet-holding rollers 56' may be the same emery rollers as those employed as the previously mentioned transfer-sheet-holding rollers 56, for example, having fine protrusions with a height of 50 to 500 μm on the surface thereof, which are disposed adjacent to the roller 70, with a gap of 0.2 to 0.5 mm interposed therebetween.

There are two distinct differences between the second example as shown in FIG. 4 and the third example shown in FIGS. 6A and 6B. One difference is that the roller 70 shown in the third example serves as both the first pressure-application roller 22 and the second heat-application roller 55 in the second example. The other difference is that a silicone-oil application section is situated below the heat-application roller 31 in the third example.

In the third example, image fixing is performed by both the heat-application roller 31 and the roller 70 in the case where a transfer sheet with high carrier liquid absorbing capacity is employed. By contrast, the combination of the roller 70 and the transfer-sheet-holding rollers 56' can achieve the image fixing of a transfer sheet with low carrier liquid absorbing capacity.

More specifically, when an unfixed-toner-image bearing transfer sheet P with high carrier liquid absorbing capacity is employed, as shown in FIG. 6A, an inner heater 57 built in the roller 70 is turned off, and an inner heater 3 in the heat-application roller 31 is turned on, so that the transfer sheet P is transported by the roller 70 and the transfer-sheet-holding rollers 56', both of which serve as transfer sheet transportation rollers. The unfixed-toner-image bearing transfer sheet P is then caused to pass the nip between the roller 70 then serving as pressure-application roller and the heat-application roller 31 with the inner heater 3 turned on, thereby completing the image fixing.

By contrast, when an unfixed-toner-image bearing transfer sheet P with low carrier liquid absorbing capacity is employed, as shown in FIG. 6B, the inner heater 3 in the heat-application roller 31 is turned off, and the inner heater 57 in the roller 70 is turned on. The unfixed-toner-image bearing transfer sheet P is caused to pass between the roller 70 serving as a heat-application roller, with the inner heater 57 turned on, and the transfer-sheet-holding rollers 56', thereby completing the image fixing. In this case, it is preferable that the roller 70 be detached from the roller 31 for avoiding the hot-offset phenomenon as shown in FIG. 6B. In the third example, therefore, the roller 70 and the transfer-sheet holding rollers 56' are incorporated in one united body and detachable from the roller 31 en bloc. Reference numeral 71 indicates a paper separation pawl to prevent the transfer sheet P from winding around the roller 70.

In the third example, as previously mentioned, the silicone-oil-application section is provided below the roller 31, which comprises a silicone oil reservoir 72, a silicone-oil-application roller 73 dipped in the silicone oil in the silicone oil reservoir 72, a scraper 74 and a scraper blade 75. In comparison with the image fixing unit in which the silicone-oil-application felt is situated above the heat-application roller as shown in FIGS. 2A and 2B, and FIG. 4, this image fixing unit has the advantages that dripping of the silicone oil onto the transfer sheet P can be completely avoided and therefore it is unnecessary to change the transporting direction of the transfer sheet P so as to avoid such dripping of the silicone oil onto the transfer sheet P.

In addition, a scraper blade 75 in contact with the roller 31 is designed to operate in the trailing direction to the direction of rotation of the roller 31, so that the mechanical load which may be applied to the roller 31 is decreased, as compared with a scraper blade designed to operate in the counter direction to the direction of rotation of the roller 31. When the heat-application roller 31 is sufficiently coated with a silicone oil, no serious problem will occur even if the scraper blade is arranged to operate in the counter direction to the direction of rotation of the heat-application roller 31. However, when the heat-application roller 31 is not sufficiently coated with a silicone oil, for instance, by the running out of the silicone oil, there is a risk that the scraper blade 75 may scratch the surface of the heat-application roller 31. In the above third example, this risk is avoided by the above-mentioned deposition of the scraper blade 75.

In the third example, either the first pressure-application roller 22 or the second heat-application roller 55 as shown in the first and second examples can be omitted, so that not only a reduction in the size of the image fixing unit, but also a reduction in the cost thereof can be realized. Furthermore, the transportation path of the transfer sheet P in the image fixing unit can be shortened, so that the occurrence of paper jam can be significantly reduced. Even if the paper jam occurs, troubleshooting of the paper jam is very easy.

In FIGS. 6A and 6B, reference numerals 77 and 78 respectively indicate a thermistor for controlling the temperature of the heat-application roller 31 and a thermistor for controlling the temperature of the roller 70, and reference numeral 79 indicates a plurality of cleaning rollers to remove toner particles from the transfer-sheet-holding rollers 56'.

In the first example shown in FIGS. 2A, 2B and 3, the second example shown in FIG. 4, and the third example shown in FIGS. 5, 6A and 6B, it is preferable that the number of copies per minute (cpm) and the paper feeding linear speed in the image fixing unit be varied at the same time, according to the type of the transfer sheet P employed, by which the amount of a carrier liquid component contained in a developer employed can be effectively decreased, depending on the type of the transfer sheet.

The image fixing unit for a wet-type electrophotographic copying machine according to the present invention may be further modified so as to comprise (a) a first image-fixing heating means comprising a surface-heated roller 81 serving as a first heat-application roller, and a pressure-application roller 82, between which a transfer sheet is transported, with an unfixed toner image on the transfer sheet being in direct contact with the heat-application roller 82, thereby fixing the toner image to the transfer sheet; (b) a second image-fixing heating means comprising a heating and silicone-oil-application roller 85 serving as a second heat-application roller which is in contact with the surface-heated roller 81 and transfers heat thereto for image fixing, and a plurality of transfer-sheet-holding rollers 86 serving as a transfer-sheet-holding means for holding the transfer sheet on the heating and silicone-oil-application roller 85, with the back side of the transfer sheet opposite to an unfixed image formed thereon being in contact with the heating and silicone-oil-application roller 85, and the unfixed toner image formed on the transfer sheet being in close vicinity of the transfer-sheet-holding rollers 86; and (c) switching means which includes means for selectively changing the transporting direction of the transfer sheet in such a manner that when the transfer sheet has a relatively high carrier liquid absorbing capacity A, the transfer sheet is transported to the first image-fixing heating means, and when the transfer sheet has a relatively low carrier liquid absorbing capacity B, the transfer sheet is transported to the second image-fixing heating means.

Figure 7:
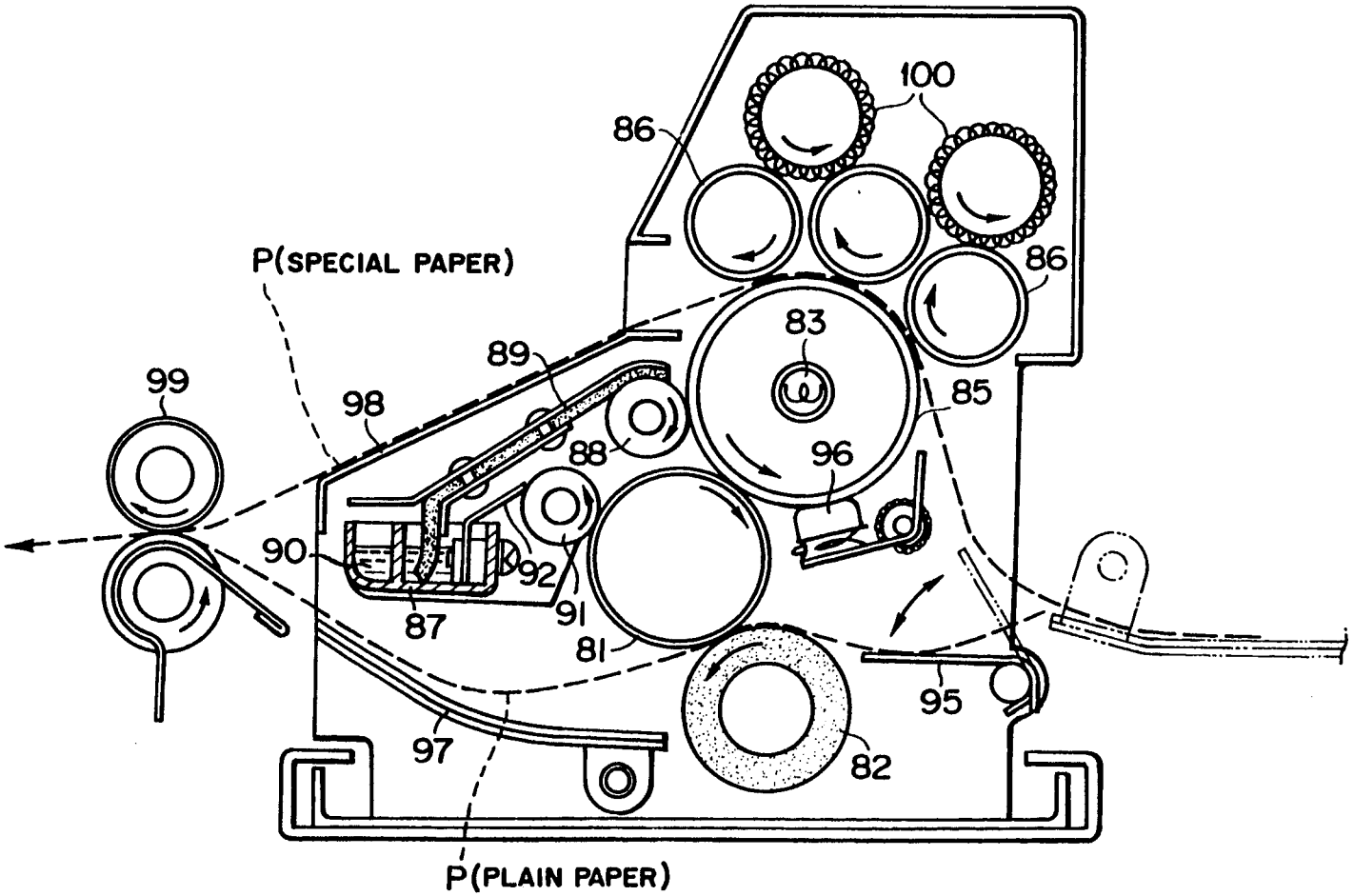
FIG. 7 is a schematic cross-sectional view of a fourth example of an image fixing unit according to the present invention.

FIG. 7 schematically shows an example of the above image fixing unit, which is hereinafter referred to as the fourth example of the image fixing unit of the present invention. In this figure, the surface-heated roller 81 (room temperature vulcanized roller) coated with a release layer made of a silicone rubber is in rolling contact with the pressure-application roller 82 coated with a silicone rubber layer; the surface-heated roller 81 is also in rolling contact with the heating and silicone-oil-application roller 85 with a built-in heater 83; and the above heating and silicone-oil-application roller 85 is disposed in close vicinity to a plurality of the transfer-sheet-holding rollers 86. The above three combinations are vertically situated in the image fixing unit.

The fixing of images to a transfer sheet with high carrier liquid absorbing capacity which is labelled as "plain paper" in FIG. 7 is performed by the combination of the surface-heated roller 81 and the pressure-application roller 82. The fixing of images to a transfer sheet with low carrier liquid absorbing capacity which is labelled as "special paper" in FIG. 7 is performed by the combination of the heating and silicone-oil-application roller 85 and the transfer-sheet-holding rollers 86.

The temperature of the surface-heated roller 81 can be elevated by the heat transferred from the heating and silicone-oil-application roller 85. More specifically, when the temperature of the heating and silicone-oil-application roller 85 is set within a range of 140° C. to 150° C., the surface temperature of the surface-heated roller 81 can reach 130° C. to 150° C. in a short time. In order to make the elevated surface temperature of the surface-heated roller 81 uniform more quickly, it is preferable that the heating and silicone-oil-application roller 85 be rotated in contact with the surface-heated roller 81. This can be sufficiently done by merely idling the two rollers prior to the copy making process.

A silicone-oil-application roller 88 is in rolling contact with the heating and silicone-oil-application roller 85 and serves to intermittently replenish the heating and silicone-oil-application roller 85 with a silicone oil 90 held by a silicone-oil-application felt 89 in order to keep the surface of the heating and silicone-oil application roller 85 uniformly coated with the silicone oil 90.

A cleaning and silicone-oil-recovery roller 91 is in rolling contact with the surface-heated roller 81. The toner particles, paper dust, clay and residual silicone oil deposited on the surface of the surface-heated roller 81 are removed by the cleaning and silicone-oil-recovery roller 91 and recovered into a silicone-oil reservoir 87 by a scraper blade 92 situated in contact with the cleaning and silicone-oil-recovery roller 91.

Reference numeral 95 indicates an image fixing unit inlet switching guide plate. Depending on the type of a transfer sheet to be employed, the position of the inlet switching guide plate 95 can be changed over by the operation of a solenoid (not shown), so that a paper transportation path is switched. The inlet switching guide plate 95 can be automatically switched, for example, by depressing a key on an operation panel (not shown) mounted on an electrophotographic copying machine, in synchronism with the selection of manual paper feeding with the operation of the solenoid, or causing an optical sensor to detect the type of the employed transfer sheet.

Reference numerals 96, 97, 98, 99 and 100 respectively indicate a temperature sensor, a transportation guide plate, an external wall of the image fixing unit which serves as a transportation guide, paper discharging rollers and cleaning rollers.

When fixing images to a transfer sheet P with high carrier liquid absorbing capacity, the image fixing unit inlet guide plate 95 is switched to the solid line position as shown in FIG. 7. The transfer sheet P is caused to pass the nip between the surface-heated roller 81 and the pressure-application roller 82 and the unfixed-toner-image bearing surface of the transfer sheet P is brought into direct contact with the surface-heated roller 81, so that the toner images are fixed to the transfer sheet P. The transfer sheet P is transported along the transportation guide plate 97 and then discharged from the copying machine via the paper discharging rollers 99.

When fixing images to a transfer sheet P with low carrier liquid absorbing capacity, the image fixing unit inlet guide plate 95 is switched to the chain line position as shown in FIG. 7. The transfer sheet P is caused to pass between the heating and silicone-oil application roller 85 and the transfer-sheet-holding rollers 86 and the back side of the unfixed toner image bearing transfer sheet P is brought into contact with the heating and silicone-oil-application roller 85, so that the toner images are fixed to the transfer sheet P. The transfer sheet P is transported along the external wall of the image fixing unit 98 and then discharged from the copying machine via the paper discharging rollers 99. The above-mentioned transfer-sheet-holding rollers 86 are emery rollers which have fine protrusions with a height of 50 to 500 μm on the surface thereof. The transfer-sheet-holding rollers 86 are situated in close vicinity to the heating and silicone-oil-application roller 85, with a gap of 0.2 to 0.5 mm interposed therebetween. Toner particles deposited on the tip of the protrusions of the pressure-application rollers 86 can be easily removed by the cleaning rollers 100.

The fourth example of the image fixing unit according to the present invention, as shown in FIG. 7, has the following advantages:

(1) There is provided in the image fixing unit only one heater, that is, the inner heater 83 incorporated in the heating and silicone-oil application roller 85, and only one temperature controlling means for the above inner heater 83, which results in energy-saving.

(2) The silicone-oil application and recovery mechanism is very simple because the silicone-oil reservoir is used for both the silicone-oil-application roller 88 and the cleaning and silicone-oil recovery roller 91.

(3) It is unnecessary to attach or detach the image fixing rollers to or from each other by applying or releasing pressure depending on the type of the transfer sheet, as shown in FIGS. 6A and 6B.

The image fixing unit for a wet-type electrophotographic copying machine according to the present invention may be further modified so as to comprise (a) a first image-fixing heating means comprising a heat-application roller 81 and a pressure-application roller 82, between which a transfer sheet is transported, with an unfixed toner image on the transfer sheet being in direct contact with the heat-application roller 81, thereby fixing the toner image to the transfer sheet; (b) a second image-fixing heating means comprising the heat-application roller 81 and a plurality of transfer-sheet-holding rollers 86 serving as a transfer-sheet-holding means for holding the transfer sheet on the heat-application roller 81, with the back side of the transfer sheet opposite to the unfixed image formed thereon being in contact with the heat-application roller 81, and the unfixed toner image formed on the transfer sheet being in close vicinity of the transfer-sheet-holding rollers 86; and (c) switching means which includes means for selectively changing the transporting direction of the transfer sheet in such a manner that when the transfer sheet has a relatively high carrier liquid absorbing capacity A, the transfer sheet is transported to the first image-fixing heating means, and when the transfer sheet has a relatively low carrier liquid absorbing capacity B, the transfer sheet is transported to the second image-fixing heating means.

Figure 8:
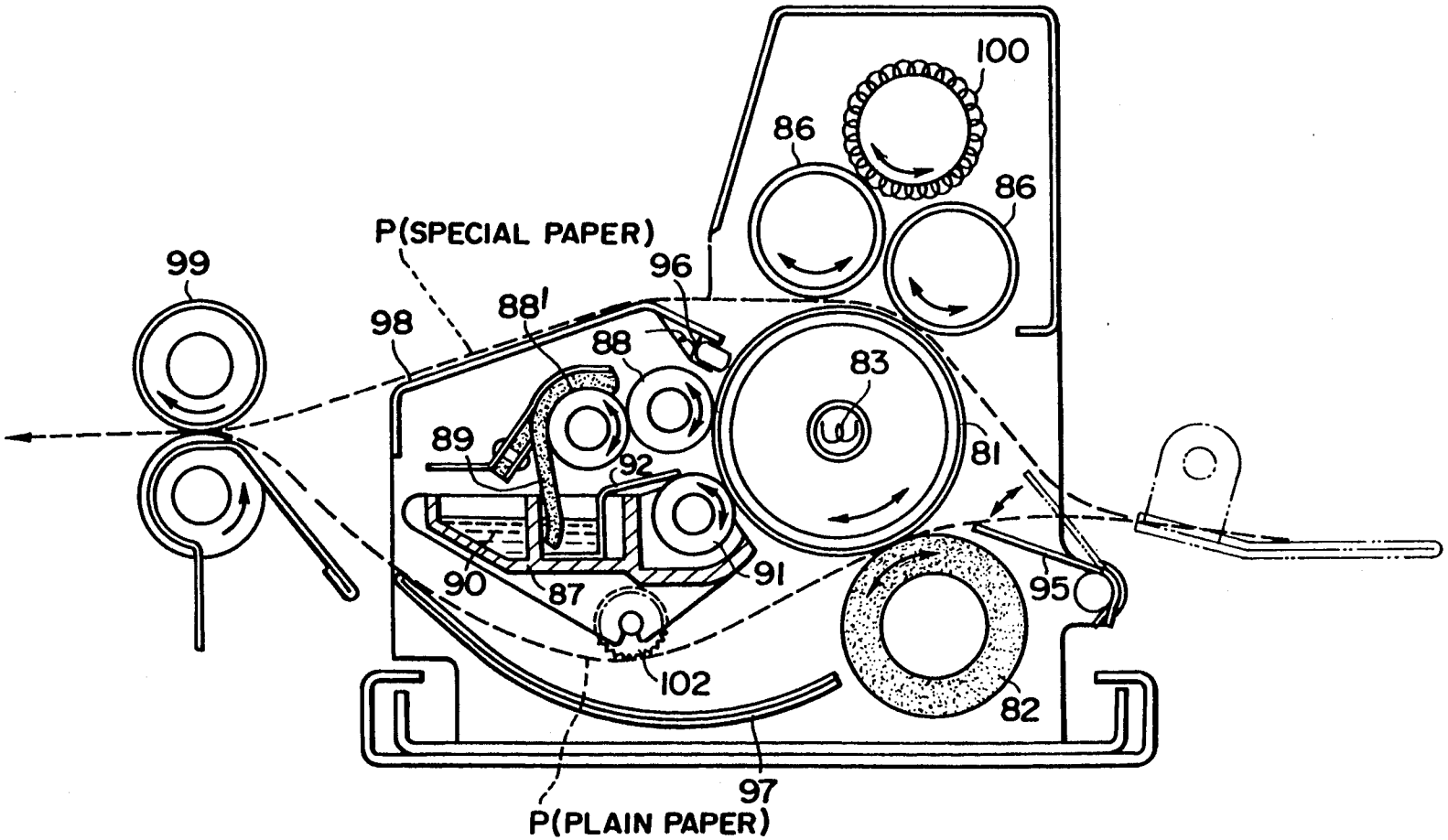
FIG. 8 is a schematic cross-sectional view of a fifth example of an image fixing unit according to the present invention.

FIG. 8 schematically shows an example of the above image fixing unit, which is hereinafter referred to as the fifth example of the image fixing unit of the present invention.

In the fifth example, as compared with the fourth example, the heating and silicone-oil-application roller 85 shown in FIG. 7 is omitted, and a first silicone-oil-application roller 88 is independently provided. In addition, the heat-application roller 81 and the pressure-application roller 82, which are in contact with each other likewise as shown in FIG. 7, are designed so as to be rotatable in both clockwise and counterclockwise directions. When the heat-application roller 81 is driven in rotation in the clockwise direction, the image fixing to the transfer sheet with high carrier liquid absorbing capacity is performed by causing the transfer sheet to pass the nip between the heat-application roller 81 and the pressure-application roller 82. To the contrary, when the heat-application roller 81 is driven in rotation in the counterclockwise direction, the image fixing to a transfer sheet with low carrier liquid absorbing capacity is performed by causing the transfer sheet to pass between the heat-application roller 81 and transfer-sheet-holding rollers 86.

The driving mechanism of the rollers for use in the fifth example of the image fixing unit will now be explained in detail.

A driving gear for driving the heat-application roller 81 can be driven in rotation in both clockwise and counterclockwise directions by an electromagnetic clutch. The above driving gear for the heat-application roller 81 engages with a gear of the first silicone-oil application roller 88, a gear of the cleaning and silicone-oil-recovery roller 91 and a gear of each transfer-sheet-holding roller 86. On the other hand, a second silicone-oil application roller 88', the cleaning roller 100 and the pressure-application roller 82 are frictionally driven by their own adjoining rollers which are driven in rotation by the above-mentioned gear.

In the fifth example of the image fixing unit shown in FIG. 8, the number of the transfer-sheet-holding rollers 86 and the number of the cleaning rollers 100 are reduced by one, respectively, as compared with the fourth example of the image fixing unit shown in FIG. 7, and a temperature sensor 96 in contact with the heat-application roller 81 is situated at a different position from that of the temperature sensor 96 of the fourth example as shown in FIG. 7. Furthermore, a second silicone-oil-application roller 88' which is in contact with the first silicone-oil-application roller 88 is added as shown in FIG. 8. Reference numeral 102 is an emery roller which is rotated and serves to guide the transfer sheet as the transfer sheet is transported in contact with the emery roller 102. The shaft of the emery roller 102 is rotatably supported at the bottom of a silicone-oil reservoir 87.

In the fifth example, when transferring images to a transfer sheet P with high carrier liquid absorbing capacity such as plain paper, an image fixing unit inlet switching guide plate 95 is switched to the solid line position, as shown in FIG. 8. The transfer sheet P is caused to pass the nip between the heat-application roller 81 which is rotated in a clockwise direction and the pressure-application roller 82, so that the surface of an unfixed-toner-image bearing transfer sheet P is brought into direct contact with the heat-application roller 81 and the images are fixed thereto. The transfer sheet P is transported along a transportation guide plate 97 and then discharged from the copying machine via paper discharging rollers 99. In this case, the first and the second silicone-oil-application rollers 88 and 88' and the heat-application roller 81 are in rolling contact with each other and rotated in the same direction at their respective contact points, and serve to uniformly apply the silicone oil held by a silicone-oil-application felt 89 to the surface of the heat-application roller 81. A cleaning and silicone-oil-recovery roller 91 is also rotated in the same direction as the direction of rotation of the heat-application roller 81 at the contact point thereof, and serves to remove toner particles, paper dust, clay and residual silicone oil from the surface-heated roller 81. The above-mentioned residual silicone oil is scraped off the cleaning and silicone-oil-recovery roller 91 by a scraper blade 92 and recovered into the silicone-oil reservoir 87.

When fixing images to a transfer sheet P with low carrier liquid absorbing capacity, the image fixing unit inlet guide plate 95 is switched to the chain line position as shown in FIG. 8. The transfer sheet P is caused to pass between the heat-application roller 81 which is rotated in a counterclockwise direction and the transfer-sheet-holding rollers 86, with the back side of the unfixed-toner-image bearing transfer sheet P in contact with the heat-application roller 81, so that the images are fixed to the transfer sheet P. The transfer sheet P is transported along an external wall 98 of the image fixing unit and then discharged from the copying machine via paper discharging rollers 99. The above-mentioned first and second silicone-oil-application rollers 88 and 88', the cleaning and silicone-oil-recovery roller 91 and the heat-application roller 81 are in rolling contact and rotated in the same direction at their respective contact points.

The image fixing temperature of the heat-application roller 81 is set at a temperature within a range of 140° to 150° C. and kept constant at the temperature by a temperature sensor 96.

Besides the advantages as given in the fourth example, the fifth example of the image fixing unit according to the present invention has the advantages that the image fixing mode can be easily changed depending on the kind of the transfer sheet P to be employed by changing the direction of rotation of the heat-application roller 81, so that the image fixing unit can be made more compact in size.

Figure 9:
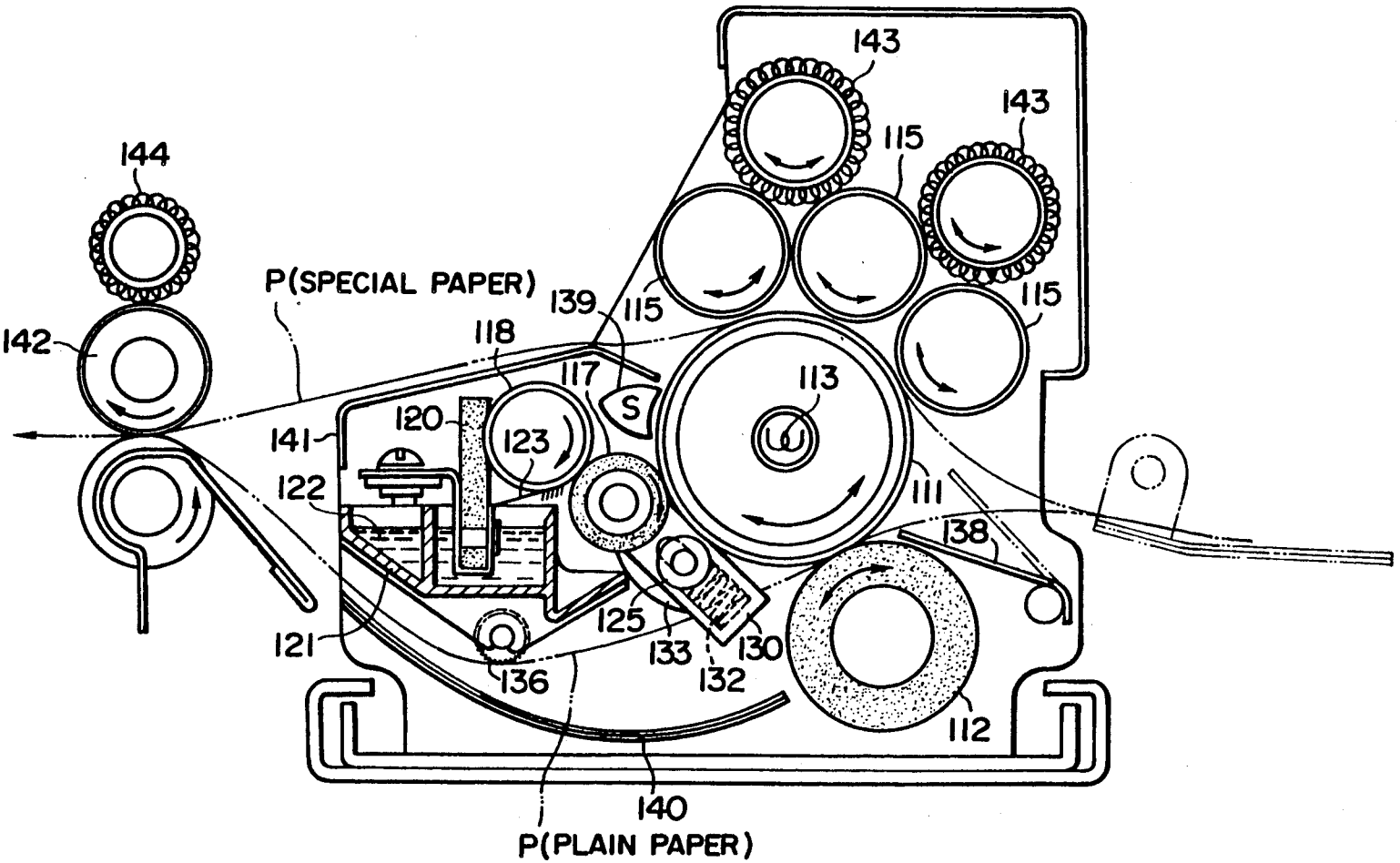
FIG. 9 is a schematic cross-sectional view of a sixth example of an image fixing unit in which a transfer sheet separation roller is incorporated according to the present invention.

FIG. 9 schematically shows a sixth example of the image fixing unit according to the present invention.

In the sixth example of the image fixing unit, a first image fixing section or a second image fixing section can be selected depending on the type of the transfer sheet P to be employed.

As shown in FIG. 9, a heat-application roller 111, coated with room temperature vulcanized rubber, having an inner heater 113 therein, is in rolling contact with a pressure-application roller 112, thereby forming a first image fixing section. On the other hand, a plurality of transfer-sheet-holding rollers 115 is situated adjacent to the heat-application roller 111, with a gap of 0.2 to 0.5 mm interposed therebetween, thereby forming a second image fixing section. The above-mentioned transfer-sheet-holding rollers 115 are emery rollers which have fine protrusions with a height of 50 to 500 μm on the surface thereof. Toner particles deposited on the protrusions of the transfer-sheet-holding rollers 115 can be easily removed by cleaning rollers 143.

The heat-application roller 111 is designed to rotate in both clockwise and counterclockwise directions. When a transfer sheet with high carrier liquid absorbing capacity is employed, the heat-application roller 111 is driven in rotation in a clockwise direction and the transfer sheet is caused to pass the nip between the heat-application roller 111 and the pressure-application roller 112 in the first image fixing section. When a transfer sheet with low carrier liquid absorbing capacity is employed, the heat-application roller 111 is driven in rotation in a counterclockwise direction and the transfer sheet is caused to pass between the heat-application roller 111 and the transfer-sheet-holding rollers 115 in the second image fixing section.

A first silicone-oil-application roller 117 is coated with a silicone rubber layer and is in contact with the heat-application roller 111. The first silicone-oil-application roller 117 also serves as a cleaning roller for the heat-application roller 111. A second silicone-oil-application roller 118 is coated with a Teflon-coated layer and is in contact with the first silicone-oil-application roller 117. A silicone oil 122 in a silicone-oil reservoir 121 is sucked up by a silicone-oil-application felt 120 and intermittently supplied to the heat-application roller 111 via the second silicone-oil-application roller 118 and the first silicone-oil-application roller 117, so that the surface of the heat-application roller 111 is kept uniformly coated with the silicone oil 122. Reference numeral 123 indicates a scraper blade, which is attached to the silicone-oil-application felt 120 and is in contact with a lower part of the second silicone-oil-application roller 118. The scraper blade 123 serves to remove toner particles and paper dust from the surface of the second silicone-oil-application roller 118.

Reference numeral 125 indicates a paper separation roller serving as a paper separating member.

Figure 10:
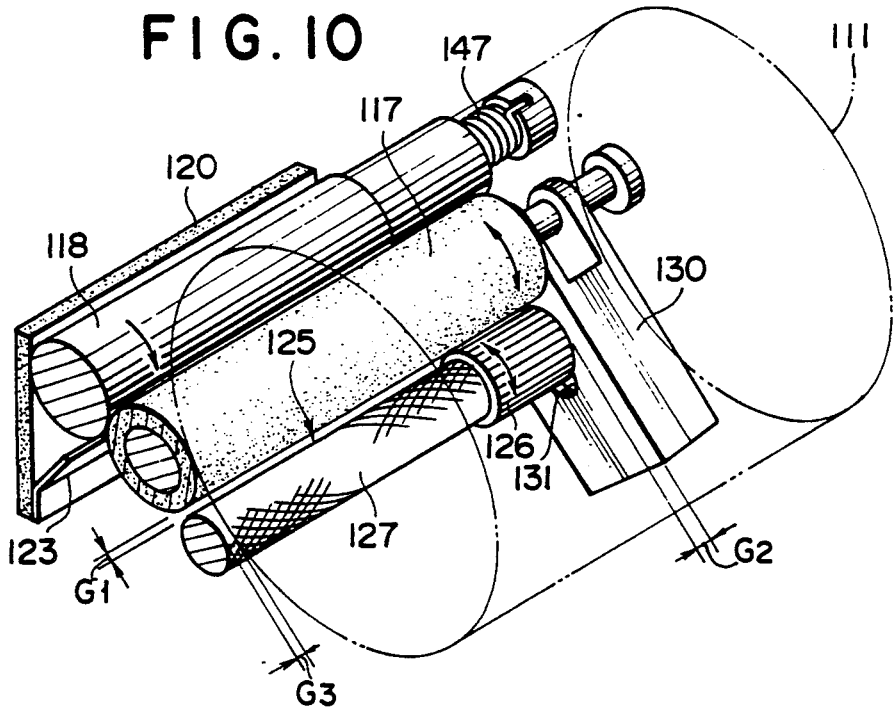
FIG. 10 is a perspective view of the transfer sheet separation roller shown in FIG. 9.
Figure 11:
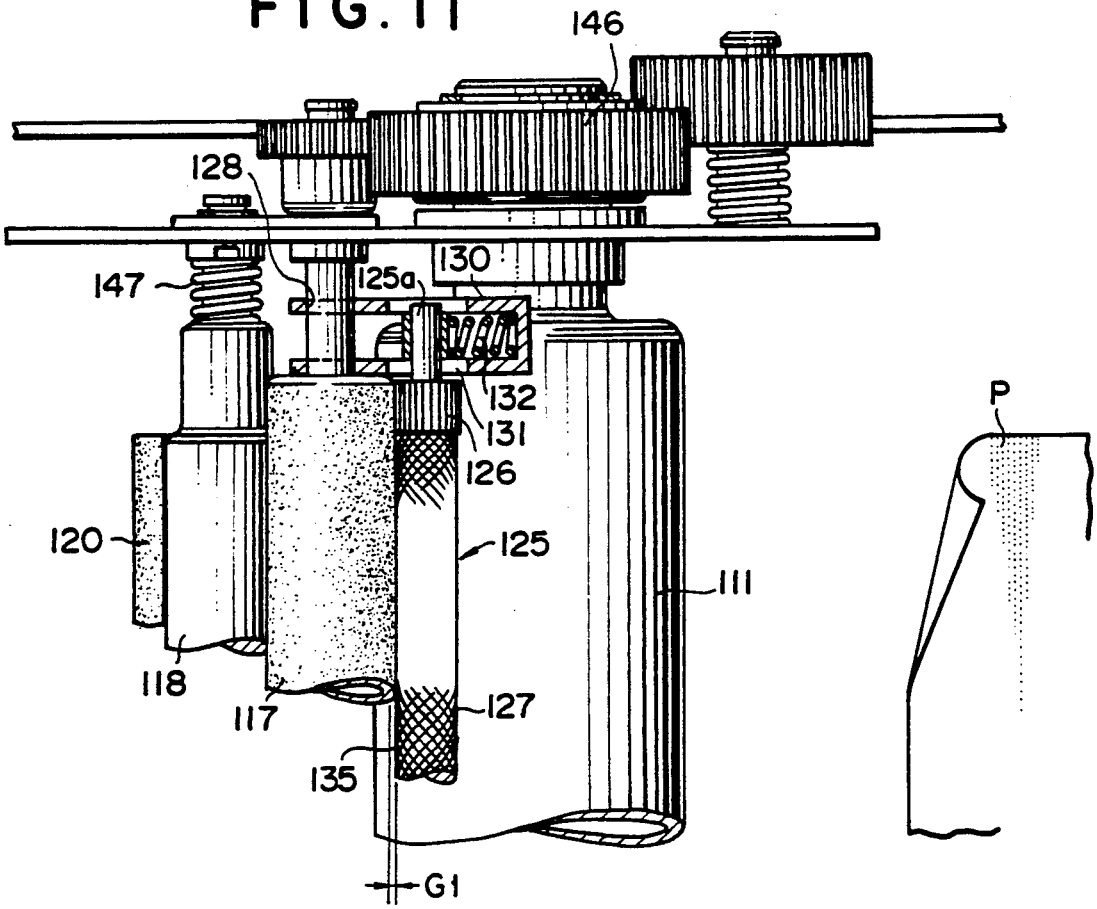
FIG. 11 is a side view of the transfer sheet separation roller shown in FIG. 9.

As shown in FIGS. 10 and 11, the paper separation roller 125 is equipped with stepped collars 126 a both ends thereof. Only one stepped collar 126 is shown in the figures. Each shaft end portion 125*a* of the paper separation roller 125 is inserted into an ellipse hole 131 of a bearing case 130 and supported thereby, which bearing case 130 engages with a shaft portion of the first silicone-oil-application roller 117 via two shaft holes 128. In each bearing case 130, a spring 132 is disposed to urge the shaft end portion 125*a* of the paper separation roller 125 toward the shaft end portion of the first silicone-oil-application roller 117. By the urging force of the spring 132, the stepped collars 126 of the paper separation roller 125 are brought into contact with the surface of the roller portion of the first silicone-oil-application roller 117, and at the same time, a small clearance $G_1$ is formed between (i) a roller portion 127 except the collars 126 of the paper separation roller 125, with a width equal to the effective paper width of the transfer sheet, and (ii) the surface of the first silicone-oil-application roller 117. Furthermore, as shown in FIG. 10, each bearing case 130 is brought into contact with the surface of the end portion of the heat-application roller 111 by the urging force of the spring 133 disposed in the bearing case 130, thereby forming a small clearance $G_2$ between the surface of the heat-application roller 111 and the stepped collar 126 of the paper separation roller 125, and a small clearance $G_3$ between the heat-application roller 111 and the roller portion 127 of the paper separation roller 125.

The roller portion 127 of the paper separation roller 125 has been subjected to a surface treatment such as knurling in order to roughen the surface thereof and improve the paper separation performance.

Reference numeral 136 in FIG. 9 is an emery roller which is rotated and serves to guide the transfer sheet as the transfer sheet is transported in contact with the emery roller 136. The shaft of the emery roller 136 is rotatably supported at a lower portion of the silicone-oil reservoir 121.

In FIG. 9, reference numerals 138, 139, 140, 141, 142, 143 and 144 respectively indicate an image fixing unit inlet switching guide plate, a temperature sensor, a transportation guide plate, an external wall of the image fixing unit serving as transportation guide, paper discharging rollers, cleaning rollers for the pressure-application rollers 115, and a cleaning roller for the paper discharging roller 142.

In FIG. 11, a reference numeral 146 indicates a driving gear for the heat-application roller 111, which driving gear 146 engages via an intermediate gear (not shown) with a gear (not shown) which is capable of driving the heat-application roller 111 in rotation in both clockwise and counterclockwise directions. Reference numeral 147 indicates a one-way clutch by which the rotation of the second silicone-oil-application roller 118 is stopped when the heat-application roller 111 is rotated in the counterclockwise direction.

Figure 12:
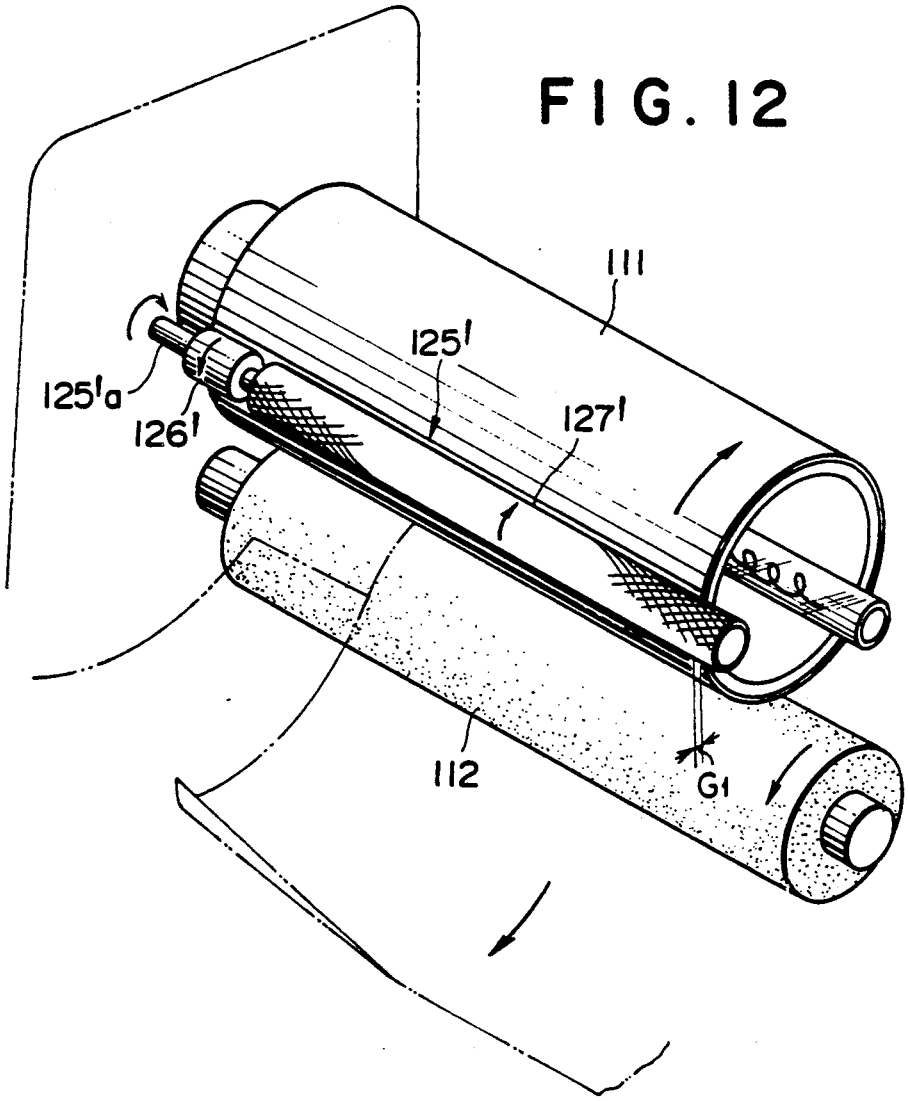
FIG. 12 is a perspective view of another example of a transfer sheet separation roller for use in an image fixing unit according to the present invention.

FIG. 12 schematically shows another example of the paper separation roller for use in the image fixing unit according to the present invention.

In the figure, a paper separation roller 125' comprises a stepped collar 126' and a roller portion 127' which are separately formed, with each stepped collar 126' rotatably mounted on each end portion of the shaft 125'a. When the paper separation roller 125' is installed in the image fixing unit according to the present invention as shown in FIG. 9, the stepped collar 126' is brought into contact with the surface of the heat-application roller 111 so as to form a small clearance $G_1$ between the surface of the roller portion 127' of the paper separation roller 125' and the surface of the heat-application roller 111, but the stepped collar 126' does not to come in contact with the surface of the first silicone-oil application roller 117. By this structure, even if the heat-application roller 111 is driven in rotation in a clockwise direction or a counterclockwise direction, the stepped collar 126' of the paper separation roller 125' is rotated in the direction opposite to the rotational direction of the heat-application roller 111, but the roller portion 127' of the paper separation roller 125' is rotated in the same direction as the direction of rotation of the heat-application roller 111.

In FIGS. 9, 10 and 11, when a transfer sheet P with high carrier liquid absorbing capacity is employed, the image fixing unit inlet switching guide plate 138 is switched to the solid line position. The transfer sheet P is caused to pass the nip between the heat-application roller 111 rotating in a clockwise direction and the pressure-application roller 112 and an unfixed toner image on the transfer sheet P is brought into direct contact with the heat-application roller 111 so that the toner image is fixed to the transfer sheet P. The transfer sheet P is transported along the transportation guide plate 140 and then discharged from the copying machine via the paper discharging rollers 142. In this image fixing unit, the first and the second silicone-oil-application rollers 117 and 118 are rotated in the same direction as the direction of rotation of the heat-application roller 111 at their respective rolling contact points and serve to uniformly apply the silicone oil deposited on the silicone-oil-application felt 120 to the surface of the heat-application roller 111. The paper separation roller 125 is rotated in the same direction as the direction of rotation of the heat-application roller 111 via the stepped collar 126 of the paper separation roller 125, that is, in the opposite direction at the facing surfaces of the two rollers 125 and 111, so that the fixed-toner-image bearing transfer sheet is prevented from being wound around the heat-application roller 111 by the paper separation roller 125.

Foreign materials such as offset toner particles and paper dust deposited on the heat-application roller 111 are transported through the first silicone-oil-application roller 117 to the second silicone-oil-application roller 118. Such foreign materials are scraped off the second silicone-oil-application roller 118 by the scraper blade 123 and recovered in the silicone-oil reservoir 121. At this moment, the roller portion 127 of the paper separation roller 125 is detached from the first silicone-oil-application roller 117 with a small clearance $G_1$, so that the surface of the paper separation roller 125 is not smeared by the foreign materials.

When fixing images to a transfer sheet P with low carrier liquid absorbing capacity, the image fixing unit inlet guide plate 138 is switched to the chain line position as shown in FIG. 9. The transfer sheet P with an unfixed toner image thereon is caused to pass between the heat-application roller 111 rotating in a counterclockwise direction and the transfer-sheet-holding rollers 115, thus the back side of the transfer sheet P is in contact with the heat-application roller 111. Thus, the toner image is fixed to the transfer sheet P. The transfer sheet P is transported along the external wall of the image fixing unit 141 and then discharged from the copying machine via the paper discharging rollers 142. In this image-fixing mode, the above-mentioned first silicone-oil-application roller 117 is rotated in the same direction as the direction of rotation of the heat-application roller 111 at their rolling contact points. However, the rotation of the second silicone-oil-application roller 118 is stopped by the one-way clutch 147 shown in FIG. 10, so that the toner particles and paper dust deposited at the tip of the scraper blade 123 are prevented from being transported to the first silicone-oil-application roller 117, and silicone oil is not applied to the first silicone-oil-application roller 117.

The image fixing temperature of the heat-application roller 111 is set at a temperature within a range of 14020 to 150° C. and maintained constant by the temperature sensor 139.

Figure 13:
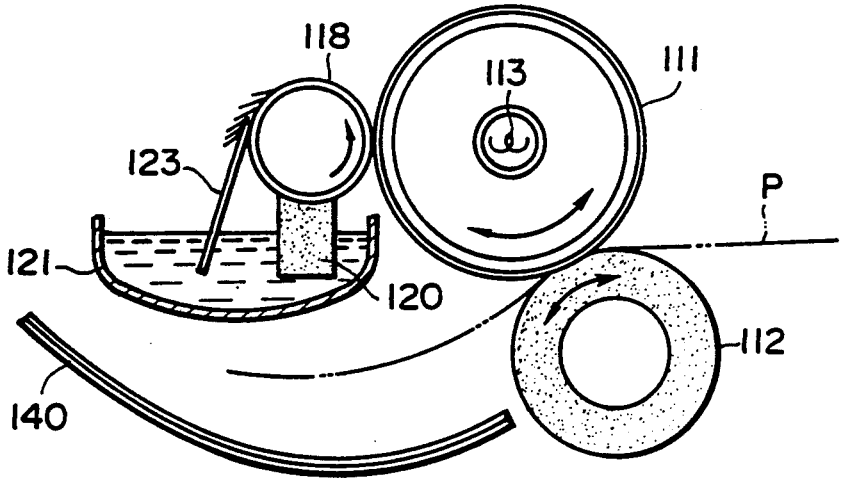
FIG. 13 is a schematic partial cross-sectional view of a seventh example of an image fixing unit according to the present invention.

FIG. 13 schematically shows a seventh example of the image fixing unit according to the present invention.

In the figure, there is not provided in the image fixing unit a silicone-oil-application roller corresponding to the silicone-oil-application roller 117 shown in FIG. 9. A silicone-oil-application roller 118 is in direct contact with the surface of a heat-application roller 111. In this case, the rotation of the silicone-oil-application roller 118 is stopped by a one-way clutch 147 (not shown) equipped therewith in the same manner as employed in the above-mentioned sixth example of the image fixing unit when the heat-application roller 111 is driven in rotation in a counterclockwise direction.

Any of the above-mentioned examples of the image fixing units according to the present invention can be incorporated in both wet-type and dry-type electrophotographic copying machines.

Furthermore, the means for stopping the rotation of the second silicone-oil-application roller is not limited to the one-way clutch 147 as employed in the present invention, but any means which has the same function as that of the one-way clutch can be employed.

In contrast to conventional image fixing units, the sixth and seventh examples of the image fixing units do not need a roller corresponding to the cleaning and silicone-oil-recovery roller, which makes the entire body of the electrophotographic copying machine compact in size.

In addition, in the case where the transfer sheet with high carrier liquid absorbing capacity is employed, the transfer sheet can be easily and effectively separated from the heat-application roller after image fixing with the aid of the paper separation roller. Further, the surface of the heat-application roller is not scratched at all by the paper separation roller because the paper separation roller is slightly detached from the surface of the heat-application roller, thereby improving the durability of the heat-application roller drastically.

What is claimed is:

1. An image fixing unit for a wet-type electrophotographic copying machine for forming a latent electrostatic image on a photoconductor element, developing said latent electrostatic image to a visible toner image and transferring said visible toner image to a transfer sheet, comprising:

(a) first image-fixing heating means for heating directly an unfixed toner image formed on a transfer sheet by a developer comprising a toner and a carrier liquid, thereby fixing said toner image to said transfer sheet, said transfer sheet having a carrier liquid absorbing capacity A or B with respect to said carrier liquid, wherein A>B;

(b) second image-fixing heating means for minimizing the content of said carrier liquid in said developer by which said toner image is formed, thereby fixing said toner image to said transfer sheet by application of heat thereto wherein said second heating means comprises:

a heat-application roller; and a transfer-sheet-holding means for holding said transfer sheet on said heat-application roller, with a back side of said transfer sheet opposite to said unfixed image thereon being in contact with said heat-application roller, and said unfixed toner image being in close vicinity with said transfer-sheet-holding means wherein said transfer-sheet-holding means comprises a plurality of holding means having fine protrusions positioned in close vicinity with said unfixed toner image formed on said transfer sheet; and (c) switching means for selectively making operable at least one of said first image-fixing heating means and said second image-fixing heating means, depending upon the carrier liquid absorbing capacity of said transfer sheet, in such a manner that when said transfer sheet has said carrier liquid absorbing capacity A, at least said first image fixing heating means is made operable, while when said transfer sheet has said carrier liquid absorbing capacity B, at least said second image-fixing heating means is made operable.

2. The image fixing unit for a wet-type electrophotographic copying machine as claimed in claim 1, wherein said fine protrusions have a height of 50 μm to 500 μm on a surface of said holding means, and a gap of 0.2 mm to 0.5 mm between each of said holding means and said heat application roller of said second image-fixing heating means.

3. The image fixing unit for a wet-type electrophotographic copying machine as claimed in claim 1, wherein said first image-fixing heating means comprises a first heating roller and a second heating roller which are adapted to be brought into contact with each other and separated from each other by said switching means.

4. The image fixing unit for a wet-type electrophotographic copying machine as claimed in claim 1, wherein said plurality of holding means comprises emery rollers said protrusions having a height of from 50 μm to 500 μm on the surface thereof, which a gap of from 0.2 mm to 0.5 mm between each said emery roller and said heating roller of said second image-fixing heat application means.

5. The image fixing unit for a wet-type electrophotographic copying machine as claimed in claim 1, wherein said first image-fixing heating means comprises a first heat-application roller and a pressure-application roller, between which said transfer sheet is transported, with said unfixed toner image on said transfer sheet being in direct contact with said first heat-application roller, thereby fixing said toner image to said transfer sheet; wherein said second image-fixing heating means comprises said heat-application-roller of said second heating means which serves as a second heat-application roller which is in rolling contact with said first heat-application roller and transfers heat thereto for image fixing, and said transfer-sheet-holding means for holding said transfer sheet on said second heat-application roller, with the back side of said transfer sheet opposite to said unfixed image formed thereon being in contact with said second heat-application roller, and said unfixed toner image formed an said transfer sheet being in close vicinity with said transfer-sheet-holding means; and said switching means comprises means for selectively changing the transporting direction of said transfer sheet.

6. The image fixing unit for a wet-type electrophotographic copying machine as claimed in claim 1, wherein said first image-fixing heating means comprises a first heat-application roller and a pressure-application roller, between which said transfer sheet is transported, with said unfixed toner image on said transfer sheet being in direct contact with said first heat-application roller, thereby fixing said toner image to said transfer sheet;

said second image-fixing heating means comprises said heat-application-roller of said second heating means which serves as a second heat-application roller and said transfer-sheet-holding means; and said switching means comprises means for selectively changing the transporting direction of said transfer sheet.

7. The image fixing unit for a wet-type electrophotographic copying machine as claimed in claim 1, wherein said first image-fixing heating means comprises a heat-application roller, and a pressure-application roller which is urged toward said heat-application roller, said transfer sheet being transported between said heat-application roller and said pressure-application roller, with said unfixed toner image on said transfer sheet in direct contact with said heat-application roller; and said switching means for selectively making operable at least one of said first image-fixing heating means and said second image-fixing heating means comprises means for detaching said pressure-application roller and said heat application roller from one another.

8. An image fixing unit for a wet-type electrophotographic copying machine for forming a latent electrostatic image on a photoconductor element, developing said latent electrostatic image to a visible toner image and transferring said visible toner image to a transfer sheet, comprising:

first image-fixing heating means for heating directly an unfixed toner image formed on a transfer sheet by a developer comprising a toner and a carrier liquid, thereby fixing said toner image to said transfer sheet, said transfer sheet having a carrier liquid absorbing capacity A or B with respect to said carrier liquid, wherein A>B wherein said first image-fixing heating means comprises:

a heat-application roller; and a pressure-application roller which is urged toward said heat-application roller, said transfer sheet being transported between said heat-application roller and said pressure-application roller, said unfixed toner image formed on said transfer sheet being in direct contact with said heat-application roller;

second image-fixing means for minimizing the content of said carrier liquid in said developer by which said toner image is formed, thereby fixing said toner image to said transfer sheet by application of heat thereto; and switching means for selectively making operable at least one of said first image-fixing heating means and said second image-fixing heating means, depending upon the carrier liquid absorbing capacity of said transfer sheet, in such a manner that when said transfer sheet has said carrier liquid absorbing capacity A, at least said first image fixing heating means is made operable, while when said transfer sheet has said carrier liquid absorbing capacity B, at least said second image-fixing heating means is made operable; and a transfer-sheet separation roller for preventing said transfer sheet from winding round said heat-application roller, wherein said transfer-sheet separation roller includes means for rotating said transfer-sheet separation roller in the same direction as a direction of rotation of said heat-application roller with a predetermined gap therebetween.

9. An image fixing unit for a wet-type electrophotographic copying machine for forming a latent electrostatic image on a photoconductor element, developing said latent electrostatic image to a visible toner image and transferring said visible toner image to a transfer sheet, which comprises:

first image-fixing heating means for directly heating an unfixed toner image formed on a transfer sheet by a developer comprising a toner and a carrier liquid, thereby fixing said toner image to said transfer sheet, said transfer sheet having a carrier liquid absorbing capacity A or B with respect to said carrier liquid, wherein $A > B$ and wherein said first image-fixing heating means comprises:

a heat-application roller; and a pressure application roller which is urged toward said heat-application roller, said transfer sheet being transported between said heat-application roller and said pressure-application roller, said unfixed toner image on said transfer sheet being in direct contact with said heat-application roller;

second image-fixing heating means for minimizing the content of said carrier liquid in said developer by which said toner image is formed, thereby fixing said toner image to said transfer sheet by application of heat thereto;

switching means for selectively making operable at least one of said first image-fixing heating means and said second image-fixing heating means, depending upon the carrier liquid absorbing capacity of said transfer sheet, in such a manner that when said transfer sheet has said carrier liquid absorbing capacity A, at least said first image fixing heating means is made operable, while when said transfer sheet has said carrier liquid absorbing capacity B, at least said second image-fixing heating means is made operable;

a first silicone-oil-application roller for applying a silicone oil to said heat-application roller, which is in rolling contact with said heat-application roller;

a second silicone-oil-application roller for applying a silicone oil to said first silicone-oil-application roller, which is in rolling contact with said first silicone-oil-application roller;

a scraper blade in contact with said second silicone-oil-application roller; and stopping means for stopping the rotation of said second silicone-oil application roller when said second image-fixing means is employed.

* * * * *

UNITED STATES PATENT AND TRADEMARK OFFICE

CERTIFICATE OF CORRECTION

PATENT NO. : 5,099,289

DATED : March 24, 1992

INVENTOR(S) : Tsuneo Kurotori et al.

It is certified that error appears in the above-identified patent and that said Letters Patent is hereby corrected as shown below:

Column 9, line 33, change "serving" to --saving--.
Column 18, line 8, change "a" to --at--.
Column 19, line 12, delete "to".
Column 20, line 20, change "14020" to --140° --.
Column 22, line 12, change "an" to --on--.

Signed and Sealed this

Tenth Day of August, 1993

*Attest:*

Michael K. Kirk

MICHAEL K. KIRK

*Attesting Officer*

*Acting Commissioner of Patents and Trademarks*